US007703732B2

(12) United States Patent
Dantuono

(10) Patent No.: US 7,703,732 B2
(45) Date of Patent: Apr. 27, 2010

(54) DECK ACCESSORY BRACKET

(76) Inventor: Lynn Marion Dantuono, 17224 Donora Rd., Silver Spring, MD (US) 20905

( * ) Notice: Subject to any disclaimer, the term of this patent is extended or adjusted under 35 U.S.C. 154(b) by 38 days.

(21) Appl. No.: 12/157,124

(22) Filed: Jun. 9, 2008

(65) Prior Publication Data

US 2009/0302180 A1 Dec. 10, 2009

(51) Int. Cl.
*A47G 29/02* (2006.01)

(52) U.S. Cl. ..... 248/235; 248/236; 248/353; 211/90.03; D8/381

(58) Field of Classification Search ..... 248/235, 248/247, 250, 236, 238, 353; 108/152; 211/90.03, 211/119.01, 180; D8/381
See application file for complete search history.

(56) References Cited

U.S. PATENT DOCUMENTS

| | | | | | |
|---|---|---|---|---|---|
| 224,863 | A | * | 2/1880 | Blessing | 248/241 |
| 285,510 | A | | 9/1883 | Perry | |
| 1,147,019 | A | | 7/1915 | Henry | |
| 2,506,119 | A | | 5/1950 | Tregear | |
| 3,070,337 | A | * | 12/1962 | Harris | 182/87 |
| 3,825,217 | A | * | 7/1974 | Fleming | 248/205.1 |
| 3,857,493 | A | | 12/1974 | Bourne | |
| 4,450,121 | A | * | 5/1984 | Bequette | 264/31 |
| D285,510 | S | | 9/1986 | Douglas et al. | |
| 4,666,115 | A | | 5/1987 | Schiro | |
| 4,767,088 | A | | 8/1988 | Fielder et al. | |
| 4,854,534 | A | * | 8/1989 | Porter | 248/222.14 |
| 5,118,059 | A | * | 6/1992 | Mainer | 248/215 |
| 5,253,837 | A | * | 10/1993 | Loux | 248/250 |
| 5,280,841 | A | * | 1/1994 | Van Deursen | 211/197 |
| 5,316,253 | A | * | 5/1994 | Flathau et al. | 248/235 |
| 5,351,842 | A | * | 10/1994 | Remmers | 211/90.03 |
| 5,390,443 | A | * | 2/1995 | Emalfarb et al. | 47/67 |
| 5,395,081 | A | | 3/1995 | Vollink | |
| 5,816,417 | A | * | 10/1998 | Reaves | 211/119.01 |
| 5,865,410 | A | * | 2/1999 | Horen | 248/242 |
| 5,941,486 | A | | 8/1999 | Riblet | |
| 6,003,826 | A | * | 12/1999 | Galloway, III | 248/519 |
| 6,126,127 | A | | 10/2000 | Riblet | |
| 6,402,108 | B1 | | 6/2002 | Remmers | |
| D461,429 | S | | 8/2002 | Holland | |
| 6,557,806 | B2 | | 5/2003 | Davies | |
| 6,672,226 | B2 | | 1/2004 | Bohnacker | |
| D507,479 | S | | 7/2005 | Jablow et al. | |
| D508,646 | S | * | 8/2005 | Gates et al. | D8/381 |
| D510,223 | S | | 10/2005 | Jablow et al. | |
| 6,971,204 | B1 | * | 12/2005 | Gibney | 47/39 |
| D522,848 | S | | 6/2006 | Nawrocki | |
| 7,150,364 | B2 | | 12/2006 | Jablow et al. | |
| D549,506 | S | * | 8/2007 | Stacy | D6/574 |

* cited by examiner

*Primary Examiner*—Anita M King
(74) *Attorney, Agent, or Firm*—William S. Ramsey

(57) ABSTRACT

Embodiments of the present invention are deck accessory brackets, which are mounted to a vertical structure and are suitable for supporting a plurality of clothes lines and a variety of objects such as rods, shelving, hanging plants and hanging bird feeders. The mountable backing plate has 2 arms joined to it, one at an outward horizontally position, and one with a vertically angled supporting arm. The top horizontal arm has positioned receptors to which clothes line and/or rods are arrayed. The face of the mountable backing plate and the top of the horizontal arm are joined to a gusset.

9 Claims, 3 Drawing Sheets

DECK ACCESSORY BRACKET

CROSS REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

1. Field of the Invention

Embodiments relate to brackets used to support objects.

2. Description of Related Art Including Information Disclosed Under 37 CFR 1.97 and 1.98.

The present invention a deck accessory bracket. Once the bracket(s) are mounted to a vertical structure they can be used to support a plurality of clothes lines and a variety of objects such as rods, shelving, hanging plants and hanging bird feeders. The invention relates to a new and improved clothes line because the line is located on a lower plane so that clothes are easily hung without raising your arms above your head and the lines are easily accessed for cleaning. The invention saves the user from having to walk their laundry across their yard to hang them, it takes away from the unsightliness of the clothes line that is placed within the yard and it frees up yard space. It would be an improvement on the umbrella clothes line hangers because there will be no need to dig and mix concrete to set the base pole into. There would be more privacy as to what is hung on the clothes line since it would back onto the user's deck. The deck accessory brackets are an improvement on some of the hanging plant and birdfeeders that are placed in the middle of the yard because the bracket is mounted to the deck it will not be susceptible to blowing over in extreme weather conditions. It is an improvement on some of the banister plant holders because the present invention can support odd shaped pots of plants that are of different weights and sizes on the shelving or rack that is created once the rods are placed.

The present invention is designed to provide additional improvements on the current inventions as more fully described below.

U.S. Pat. No. 5,280,841 issued to Van Deursen, contained a portable support assembly for the drying of clothes. The device has a set of arms that extend up and outwardly away from a central pole that is placed on top of the ground with a supporting structure.

U.S. Pat. No. 6,971,204 issued to Gibney, contained a flowerpot baluster bracket, the bracket is used to support a potted plant on a vertical baluster.

U.S. Pat. No. 3,857,493 issued to Bourne, contained a collapsible garmet dryer consisting of a post member with a plurality of arms pivotally attached. The post is stabilized by anchoring it into the ground.

U.S. Pat. No. 6,971,204 issued Dec. 6, 2005 to Gibney is titled Flower Pot Baluster Bracket.

U.S. Pat. No. D549,506 issued Aug. 28, 2007 to Stacy is titled Clothing Rack.

U.S. Pat. No. 5,865,410 issued Feb. 2, 1999 to Horen is titled Universal Staging Bracket.

U.S. Pat. No. 5,816,417 issued Oct. 6, 1998 to Reaves is titled Mini Clothes Line.

U.S. Pat. No. 6,003,826 issued Dec. 21, 1999 to Galloway is titled Supporting System For Patio Deck Accessories.

U.S. Pat. No. 5,118,059 issued Jun. 2, 1992 to Mainer is titled Support Brackets.

U.S. Pat. No. 5,390,443 issued Feb. 21, 1995 to Emalfarb is titled Railing Hanger.

U.S. Pat. No. 4,666,115 issued May 19, 1987 to Schiro is titled Plant Hanger.

U.S. Pat. No. D568,727S issued May 13, 2008 to Walker is titled Adjustable Plant Box Railing Bracket.

U.S. Pat. No. D461,429S issued Aug. 13, 2002 to Holland is titled Hanging Plant Brace.

U.S. Pat. No. 5,395,081 issued Mar. 7, 1995 to Vollink is titled Square Post Mounted Hanger.

U.S. Pat. No. 285,510 issued Sep. 25, 1883 to Perry is titled Nail Driver's Harness and Lath Holder.

U.S. Pat. No. 1,147,019 issued Jul. 20, 1915 to Henry is titled Article Holder.

U.S. Pat. No. 2,506,119 issued May 2, 1950 to Tregear is titled Bracket.

U.S. Pat. No. 7,150,364 issued Dec. 19, 2006 to Jablow et al is titled Shelving.

U.S. Pat. No. D522,848S issued Jun. 13, 2006 to Nawroki is titled Shelving Component.

U.S. Pat. No. D510,223S issued Oct. 4, 2005 to Jablow et al is titled Shelving.

U.S. Pat. No. D507,479S issued Jul. 19, 2005 to Jablow et al is titled Shelving Component.

U.S. Pat. No. 6,672,226 issued Jan. 6, 2004 to Bohnacker is titled Bracket System for Shelving.

U.S. Pat. No. 6,402,108 issued Jun. 11, 2002 to Remmers is titled Shelving Bracket.

U.S. Pat. No. 6,126,127 issued Oct. 3, 2000 to Riblet is titled Bracket Assembly.

U.S. Pat. No. 5,941,486 issued Aug. 24, 1999 to Riblet is titled Bracket Assembly.

U.S. Pat. No. 5,351,842 issued Oct. 4, 1994 to Remmers is titled Shelf and Support Assembly.

U.S. Pat. No. 5,280,841 issued Jan. 25, 1994 to Deursen is titled Portable Support Assembly.

U.S. Pat. No. 6,557,806 issued May 6, 2003 to Davies is titled Deck Mountable Plant Stand.

U.S. Pat. No. 4,767,088 issued Aug. 30, 1988 to Fielder et al is titled Multistation Bird Feeder support.

U.S. Pat. No. D285510 issued Sep. 9, 1986 to Douglas et al. is titled Bracket For A Hanging Plant, or Similar Article.

The foregoing examples of the related art and limitations related therewith are intended to be illustrative and not exclusive. Other limitations of the related art will become apparent to those of skill in the art upon a reading of the specification and a study of the drawings.

BRIEF SUMMARY OF THE INVENTION

The present invention consists of an accessory bracket than can be mounted on a vertical structure that is able to support single or multiple items in various combinations.

Embodiments include an accessory bracket suitable for supporting clothes line or rods, shelving, hanging plants or hanging bird feeders which comprises a flat mounting plate capable of being mounted to a vertical support, the plate having an upper hole adapted to receiving a horizontal arm, and a lower hole adopted to receiving an angle arm. There is a horizontal arm joined to the plate, the horizontal arm having a top side and a bottom side and a first end and a second end, the horizontal arm attached at a first end to the mounting plate at the upper hole.

There is an angled arm having a first end and a second end, the angled arm attached by the first end to the mounting plate at the lower hole, the angled arm attached at the second end to the second end of the horizontal arm. There is a gusset, the gusset having the shape of a truncated triangle, the gusset is attached at its base to the mounting plate, the gusset attached along its length to the top side of the horizontal arm, the gusset sloping downward from its base to the truncated point of the gusset.

The following embodiments and aspects thereof are described and illustrated in conjunction with systems, tool and methods which are meant to be exemplary and illustrative, not limiting in scope. In various embodiments, one or more of the above-described problems have been reduced or eliminated, while other embodiments are directed to other improvements.

In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

DETAILED DESCRIPTION OF THE INVENTION

As shown in FIGS. 1 and 2, an accessory bracket that will be made of any suitable material that will be joined together. The mounting plate to the bracket will be stamped from a single piece of sheet metal with the outer dimensions measuring approximately 12" long×3" wide×0.090 thick, which will fit onto the vertical posts. The plate will be debured around each outer edge. There will be 1 square and 1 rectangular cut out in the plate to join the approximately 16 gage, ¾" square steel arms into. Each of the 2 arms will be welded into its place with the lower arm vertically positioned on an angle that will be used to support the outward horizontally positioned arm. The outward horizontal arm will be vertically lined with approximately 5, ¼" thru holes positioned at approximately 2" apart. On top of the horizontally positioned arm there will be joined a triangular gusset that will have been stamped from a single piece of sheet metal measuring approximately 2¾"×3"×0.090. The gusset will be welded to the mounting plate with the top of the triangle adjoined via weld to the horizontally positioned arm, at approximately 3" away from the face of the mounting plate. The triangular gusset will be welded on an approximate 3-5 degree downward slope which will allow for rainwater runoff. Each outward horizontally positioned arm will be left with an open end this will be covered with a plastic cap. All of the said items will be powder coated with an exterior finish.

It is understood that although the above invention has been described in detail, that various changes and modifications may be made which do not exceed the scope of the appended claims.

Figure 1B:
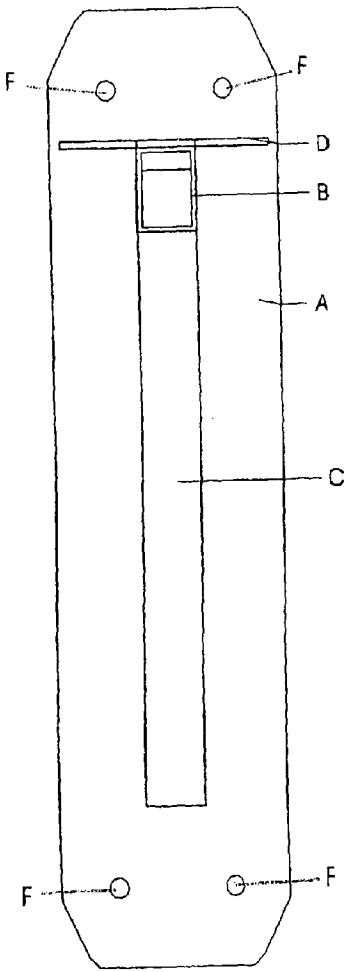
FIG. 1B is a front view of an embodiment.
Figure 1A:
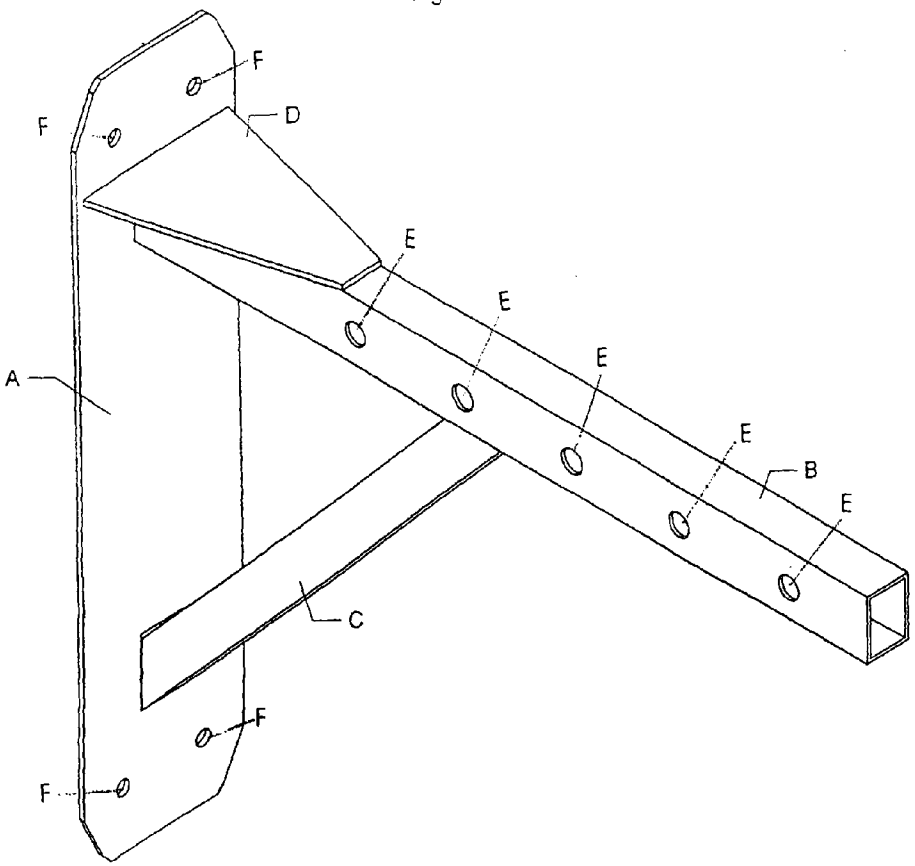
FIG. 1A is a perspective view of the front of an embodiment.

FIG. 1A is a perspective view of the front of an embodiment. Visible in FIG. 1A is the flat mounting plate A, the horizontal arm B, the lower arm C, the triangular gusset D, and the thru holes E, and the plate mounting holes F.

FIG. 1B is a front view of an embodiment. Visible in FIG. 1B are flat mounting plate A, horizontal arm B, lower arm C, triangular gusset D and plate mounting holes F.

Figure 1D:
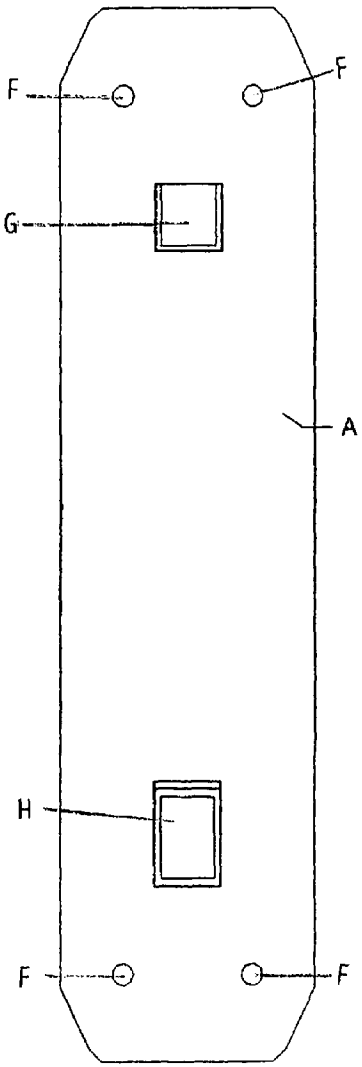
FIG. 1D is a back view of an embodiment.
Figure 1C:
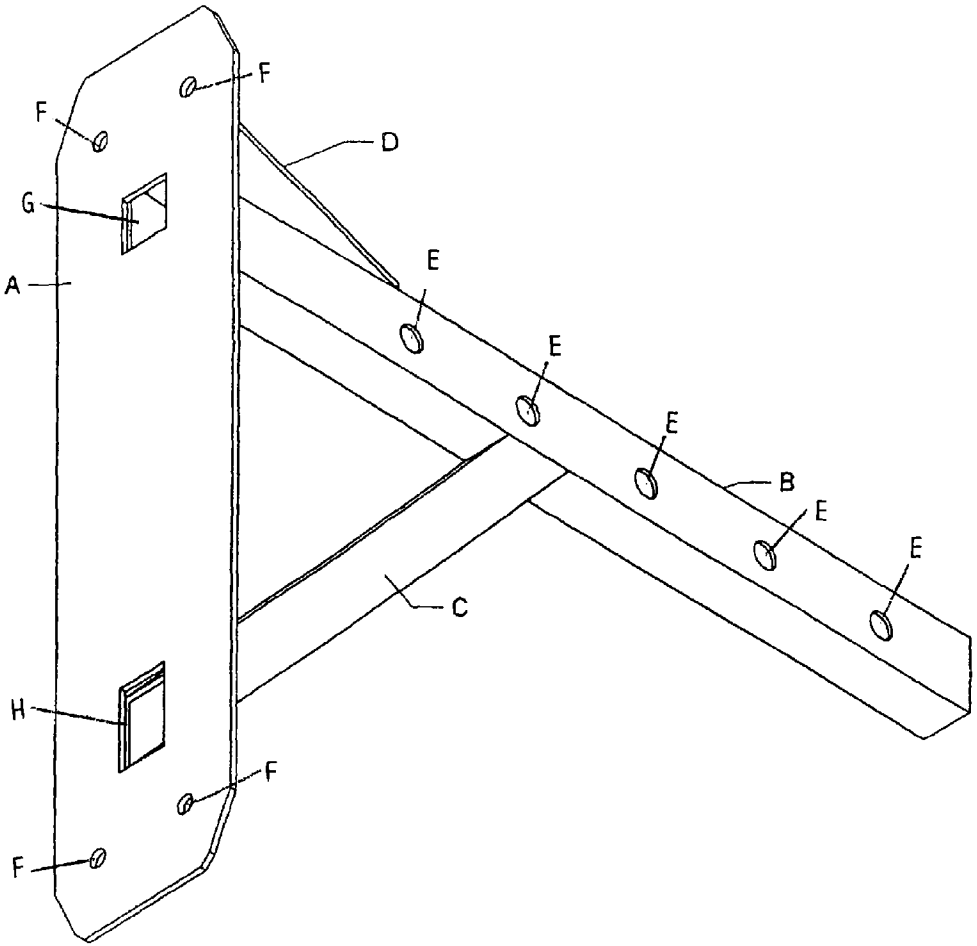
FIG. 1C is a perspective view of the back of an embodiment.

FIG. 1C is a perspective view of the back of an embodiment. Visible in FIG. 1C are flat mounting plate A, horizontal arm B, lower arm C, triangular gusset D, thru holes E, plate mounting holes F, plate horizontal arm hole G, and plate angle arm hole H.

FIG. 1D is a back view of an embodiment. Visible in FIG. 1D is flat mounting plate A, plate mounting holes F, plate horizontal arm hole G, and plate angle arm hole H.

Figure 1E:
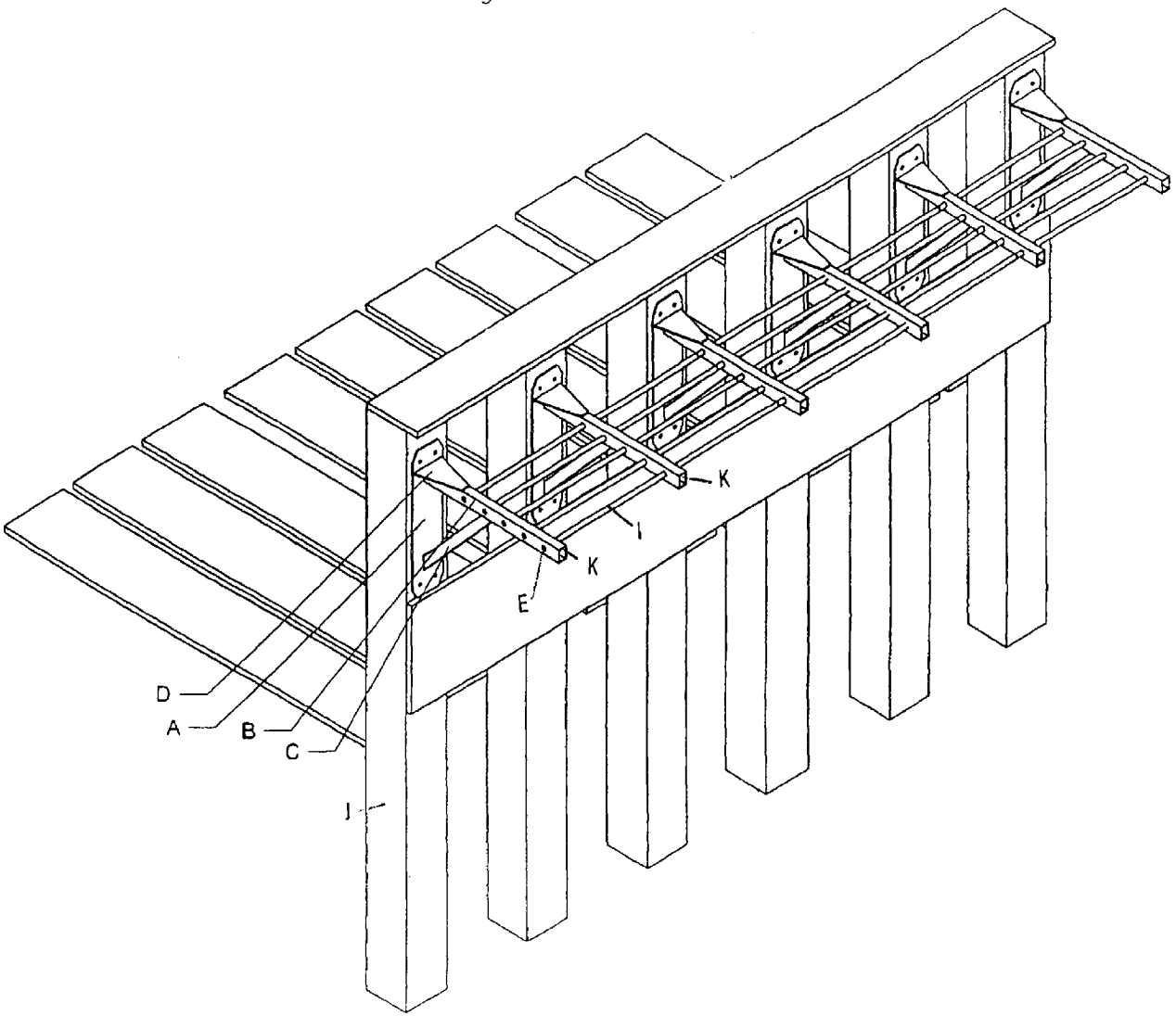
FIG. 1E is a perspective view of an embodiment attached to a vertical support.

FIG. 1E is a perspective view of an embodiment attached to a vertical post. Visible in FIG. 1E is flat mounting plate A, horizontal arm B, lower arm C, triangular gusset D, clothes line I, and vertical post J. In FIG. 1E the clothes line extends through the horizontal arm thru holes E from one accessory bracket K to adjacent accessory brackets K. Although a clothes line I is depicted in FIG. 1E, other objects may be supported by the embodiments, such as rods, shelving, hanging plants and hanging bird feeders.

Embodiment accessory brackets may be made of any suitable material, such as steel. The flat mounting plate may be stamped from a single piece of sheet metal such as steel. The arms may be made of steel. The arms may be welded to the steel mounting plate and to each other.

In embodiments the triangular gusset plate is welded to the front of the mounting plate and to the top of the horizontal arm and is positioned to allow for drainage of rainwater, with a downward slope, which may be 3-5 degrees.

While a number of exemplary aspects and embodiments have been discussed above, those of skill in the art will recognize certain modifications, permutations, additions and sub combinations thereof. It is therefore intended that the following appended claims and claims hereafter introduced are interpreted to include all such modifications, permutations, additions and sub-combinations as are within their true spirit and scope. The applicant or applicants have attempted to disclose all the embodiments of the invention that could be reasonably foreseen. There may be unforeseeable insubstantial modifications that remain as equivalents.

What is claimed is:

1. An accessory bracket suitable for supporting a plurality of clothes line and/or various objects such as: rods, shelving, hanging plants and hanging bird feeders, comprising of:

a mounting plate capable of being mounted to a vertical support, the plate having an upper hole adapted to receiving a horizontal arm, and a lower hole adapted to receive an angle arm, a horizontal arm which is joined to the plate, the horizontal arm having a top side and a bottom side and a first end and a second end, the horizontal arm attached at a first end to the mounting plate at the upper hole, an angled arm having a first end and a second end, the angled arm attached by the first end to the mounting plate at the lower hole, the angled arm attached at the second end to the second end of the horizontal arm, a gusset, the gusset having the shape of a truncated triangle, the gusset attached at its base to the mounting plate, the gusset attached along its length to the top side of the horizontal arm, and the gussed sloping downward from its base to the truncated point of the gusset.

2. The accessory bracket of claim 1 further comprising the mounting plate capable of being mounted on the structure that is able to support single or multiple items in various combinations.

3. The accessory bracket of claim 1 wherein the bracket is made of any suitable material.

4. The accessory bracket of claim 1 wherein the plate is stamped from a single piece of sheet metal.

5. The accessory bracket of claim 1 wherein the plate is capable of being mounted to a vertical post or structure.

6. The accessory bracket of claim 1 wherein the horizontal arm has positioned receptors capable of retaining a plurality of clothes line and/or rods.

7. The accessory bracket of claim 1 wherein the horizontal arm is capable of supporting various objects.

8. The accessory bracket of claim 1 wherein the gusset is welded to the mounting plate and to the top of the horizontal arm.

9. The accessory bracket of claim 1 wherein the downward slope of the gusset is 3-5 degrees.

* * * * *